United States Patent [19]

Watts

[11] Patent Number: 4,715,949

[45] Date of Patent: Dec. 29, 1987

[54] HEAVY METAL SEPARATOR

[76] Inventor: David L. Watts, 1114 - 11th, Benton City, Wash. 99320

[21] Appl. No.: 927,314

[22] Filed: Nov. 5, 1986

Related U.S. Application Data

[63] Continuation-in-part of Ser. No. 885,835, Jul. 14, 1986.

[51] Int. Cl.[4] ..... B03B 5/68; B03B 7/00

[52] U.S. Cl. ..... 209/17; 209/44; 209/157; 209/158

[58] Field of Search ..... 209/12, 13, 17, 18, 209/44, 157–161, 352, 423, 454

[56] References Cited

U.S. PATENT DOCUMENTS

| | | | |
|---|---|---|---|
| 26,236 | 11/1859 | Parkhurst | 209/155 |
| 146,168 | 1/1871 | Collon | 209/158 |
| 674,169 | 5/1901 | Klein | 209/155 |
| 1,048,171 | 12/1912 | Hughes | 209/157 |
| 1,483,371 | 2/1924 | Miller | 209/159 |
| 1,912,077 | 5/1933 | Hoyois | 209/18 |
| 1,961,666 | 6/1934 | Hoyois | 209/18 |
| 2,065,967 | 12/1936 | Clark et al. | 209/155 |
| 2,325,881 | 8/1943 | Robertson | 209/155 |
| 2,560,429 | 7/1951 | France | 209/44 |
| 2,570,035 | 10/1951 | Laughlin | 209/17 |
| 4,101,419 | 7/1978 | Bergman | 209/13 |
| 4,388,182 | 6/1983 | Hudson | 209/158 |
| 4,523,989 | 6/1985 | Graefe | 209/44 |

*Primary Examiner*—S. Leon Bashore
*Assistant Examiner*—Thomas M. Lithgow
*Attorney, Agent, or Firm*—Wells, St. John & Roberts

[57] ABSTRACT

A heavy metal separator for removing heavy metal particles and flakes from ore. It has a feed hopper which feeds a slurry of ore over an inclined screen in a separation chamber. The smaller particles pass through the screen into a second section of the separation chamber. The larger particles wave downwardly off the lower end of the screen into a first section of the separation chamber. A stream of water is directed by baffles upward through the second section counter current to the flow of materials. The water washes the less dense waste material out of the second section into the first section. The fine heavy metal particles and flakes, being more dense, settle downwardly to a collection point at the bottom of the second section. The larger concentrates and fine waste material move downwardly through the first section to an outlet, where they pass into a second separation chamber. An upwardly moving stream of water in the second separation chamber washes all waste material out of the separator while allowing the more dense coarse heavy metal particles and flakes to move downwardly through the water into a collection point at the bottom of the second separation chamber.

22 Claims, 4 Drawing Figures

2
10
82
10
80
92
93
17
83
67
89
71
85
91
72
66
55
87
15
26
86
84
88
54
14
22
34
30
16
40
28
13
12
68
42
69
18
62
50
63
46
47
95
57
59
43
60
44
65
45
52
2
81

HEAVY METAL SEPARATOR

RELATED APPLICATIONS

This is a continuation-in-part of copending application Ser. No. 885,835, filed July 14, 1986 and titled "Heavy Metal Separator".

FIELD OF THE INVENTION

This invention relates to a heavy metal separator for separating ore concentrates into heavy metal and waste material.

BACKGROUND OF THE INVENTION

Various heavy metals having a high economic value, such as gold, silver and platinum, are often found in particle or flake form in a deposit of earthen material. In order to extract the valuable metals from the remaining surrounding waste earth material, there have been numerous prior art developments used.

The desired heavy metals are generally found in what are termed placer deposits, which normally occur through the process of weathering and erosion. Placer deposits are generally found in or around the beds of existing streams and rivers, or in or along the beds of ancient streams and rivers.

Most of the separation devices and methods involve the use of water because of its properties with respect to separating and breaking up particles of earthen material.

Very often the placer deposits in which the valuable heavy metals are found are small, and particularly in the present day are very remote from such things as roads and electrical power. Because of this, it is desirable that a heavy metal separator be portable and require a minimal amount of electrical power to operate, so that a small portable generator can be utilized with it.

One of the earlier and most simple of the separation methods involve the use of what is commonly known as a "gold pan". The earth material containing the desired heavy metals was placed into the pan along with an amount of water. Through a combination of circular and rocking motions, the waste earth material was eventually washed out of the gold pan, leaving the desired heavy metals in the pan. The disadvantage inherent in the use of a gold pan is that it is very slow, and only a small volume of material can be processed at one time.

Other prior art methods included such devices as riffle beds, shaker tables, jigs, sluice boxes, and combinations of the above.

Another method of separating heavy metals from waste material utilizes an apparatus which directs a descending stream of heavy metal and earthen material into an ascending stream of water, with the water forcing the lighter waste material up and out of the apparatus while at the same time allowing the heavy metal to settle to the bottom of the apparatus for collection.

An example of this latter type of apparatus is shown in U.S. Pat. No. 4,101,419 to Bergman. In the Bergman patent, a cone shaped chamber has a plastic tube at the bottom with a water inlet near the bottom of the cone shaped chamber. The earthen material with the heavy metal particles included is placed into the cone shaped chamber, and an upwardly moving stream of water is introduced into the bottom of the cone. Even though the volume of the water entering the cone is very low, with low head pressure, the apparatus is supposed to wash waste material out of the top of the cone and allow heavy metal particles to settle to the bottom.

With the Bergman apparatus, if there is much variation in the size of the waste particles and heavy metal particles, a large number of waste material particles will also settle to the bottom, since the larger waste particles will weigh as much or more than the smaller heavy metal particles and will settle to the bottom of the cone.

In order to alleviate this problem, the Bergman apparatus also includes a screen which is positioned at the top of the cone. The material to be separated is placed in the screen which is manually agitated to facilitate the passage of the finer material through the screen downward into the cone, thence to be separated into heavy metal particles and waste material.

While the apparatus shown in the Bergman reference is easily transportable, it has several disadvantages. The first of these is that in order to obtain any initial size separation with the screen, the screen must be manually agitated and must be positioned below the level of water in the cone in order to separate the finer material from the coarser material. The screen must be physically removed and the coarse material emptied from the screen when it becomes filled. The separation process can then be restarted, with the coarser material being introduced into the cone. This, however, necessitates an adjustment of the volume of water which is flowing into the cone. Because of the low water pressure which is introduced into the cone, a lot of waste material will enter into the bottom of the cone along with the heavy metal particles.

Another apparatus for separating ores is shown in U.S. Pat. No. 1,961,666 to Hoyois. The Hoyois reference discloses a horizontal trough with at least one opening in the bottom of the trough which is in communication with a chamber underneath the trough. An upwardly flowing stream of water moves through the chamber. The most dense particles settle downwardly through the opening in the trough and through the chamber. The dense particles pass through the upwardly moving stream of water into the bottom of the chamber, where they are collected and removed. The remaining material is washed out the top of the chamber. In actual practice, a series of chambers are normally disposed below the trough, with successively smaller groups of particles initially passing from the trough into each of the successive chambers. The material washed from one chamber is washed into the next, and so on.

There are several disadvantages to the Hoyois apparatus. The first is that it is designed to handle material with particle sizes ranging from 20 to 80 millimeters, which means the apparatus will be fairly large. This makes the system essentially nontransportable. A second disadvantage is that material is collected at the bottom of each of the individual separation chambers. This means that there must be a method of conveying the waste material from each of the separation chambers. In addition, if this apparatus were used in an attempt to settle heavy metal particles from a stream of material passing over the trough, waste particles which were of the same approximate weight as the heavy metal particles passing through each of the various openings into the bottoms of the successive separation chambers would also pass downwardly through the separation chambers and be mixed with the desired heavy metal particles at the bottom of the chambers.

None of the prior art systems provide a transportable and easily usable heavy metal separation device which can handle a relatively large volume of ore concentrates in an essentially automatic manner, and ensure a very high recovery rate of the desired heavy metal particles from the ore concentrates.

BRIEF DESCRIPTION OF THE DRAWINGS

The preferred embodiment of the invention is illustrated in the accompanying drawings, in which.

DETAILED DESCRIPTION OF THE PREFERRED EMBODIMENT

Figure 1:
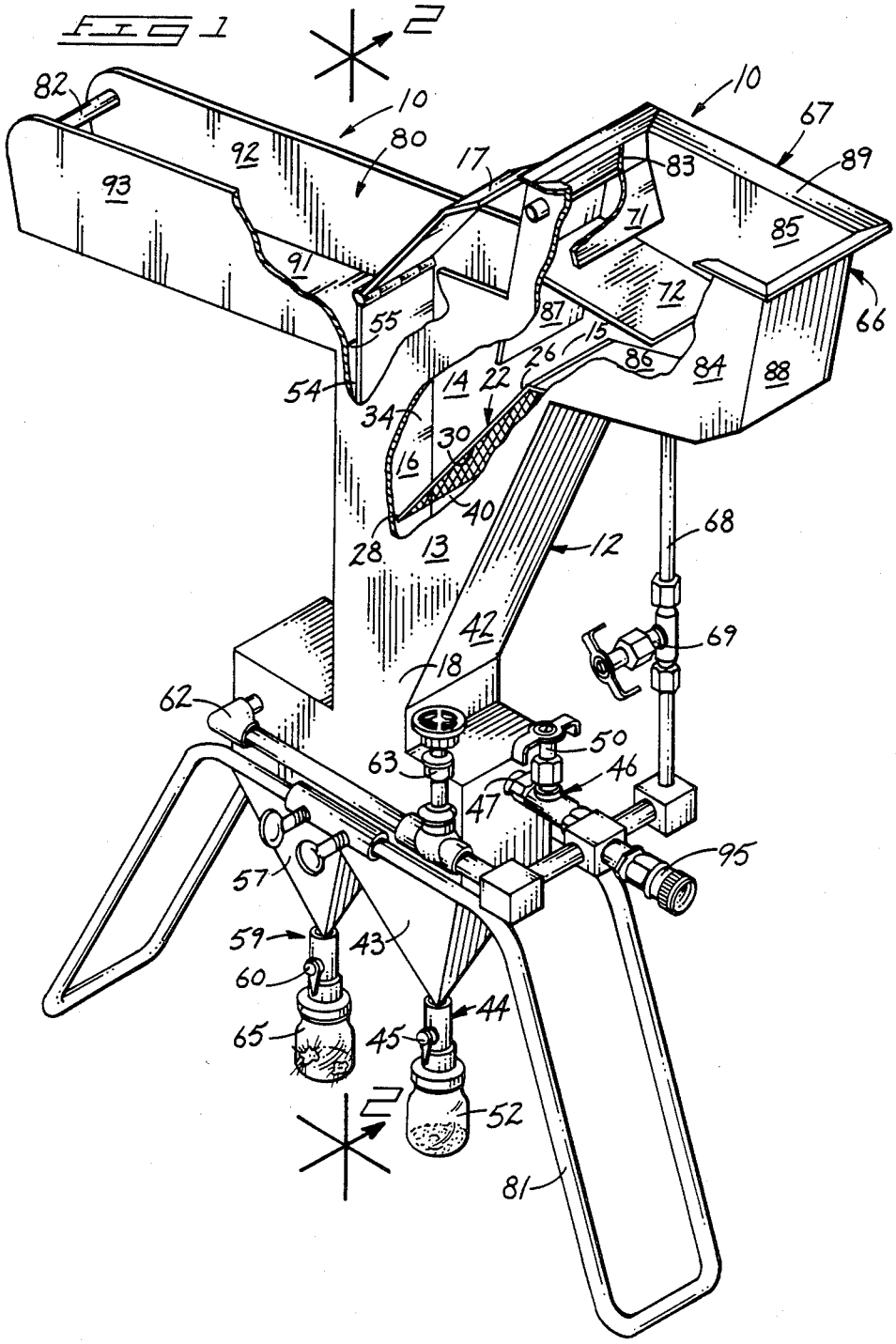
FIG. 1 is a perspective view of the heavy metal separator, partially broken away.

In compliance with the constitutional purpose of the Patent Laws "to promote the progress of science and useful arts" (Article 1, Section 8), applicant submits the following disclosure of the invention.

The instant invention arose out of the need for an easily transportable heavy metal separator which can be carried to and operated at remote sites. It has an additional advantage of being able to process a fairly high volume of material. It obtains a very high separation rate, approaching recovery of 95–98% of the heavy metal contained within a body of earthen material (ore) which is to be separated. The heavy metal separator of the instant invention is referred to in the accompanying drawings generally with the reference numeral 10.

The earthen material undergoes a preliminary sizing operation and the ore from the sizing operation is placed in the top of separator 10 where it is mixed with water to form a slurry. The slurry then flows gravitationally downward through the separator 10. As the slurry flows downward through separator 10 an initial separation of fine concentrate material from coarse concentrate material takes place.

As the fine material is being separated from the coarse material, the separated fine material is undergoing a second separation process. The separated fine material flows downwardly into an ascending stream of water. The fine heavy metal particles are dense enough to settle through the ascending stream of water to the bottom of separator 10. The fine waste material is less dense and is washed into another section of separator 10 which also receives the coarse material.

The coarse concentrate material and remaining waste fine material flow into a second chamber through which another ascending stream of water is moving. The coarse heavy metal particles are dense enough to pass downwardly through the second ascending stream of water to the bottom of the second chamber. The coarse and fine waste material is washed upwardly out of separator 10.

Figure 2:
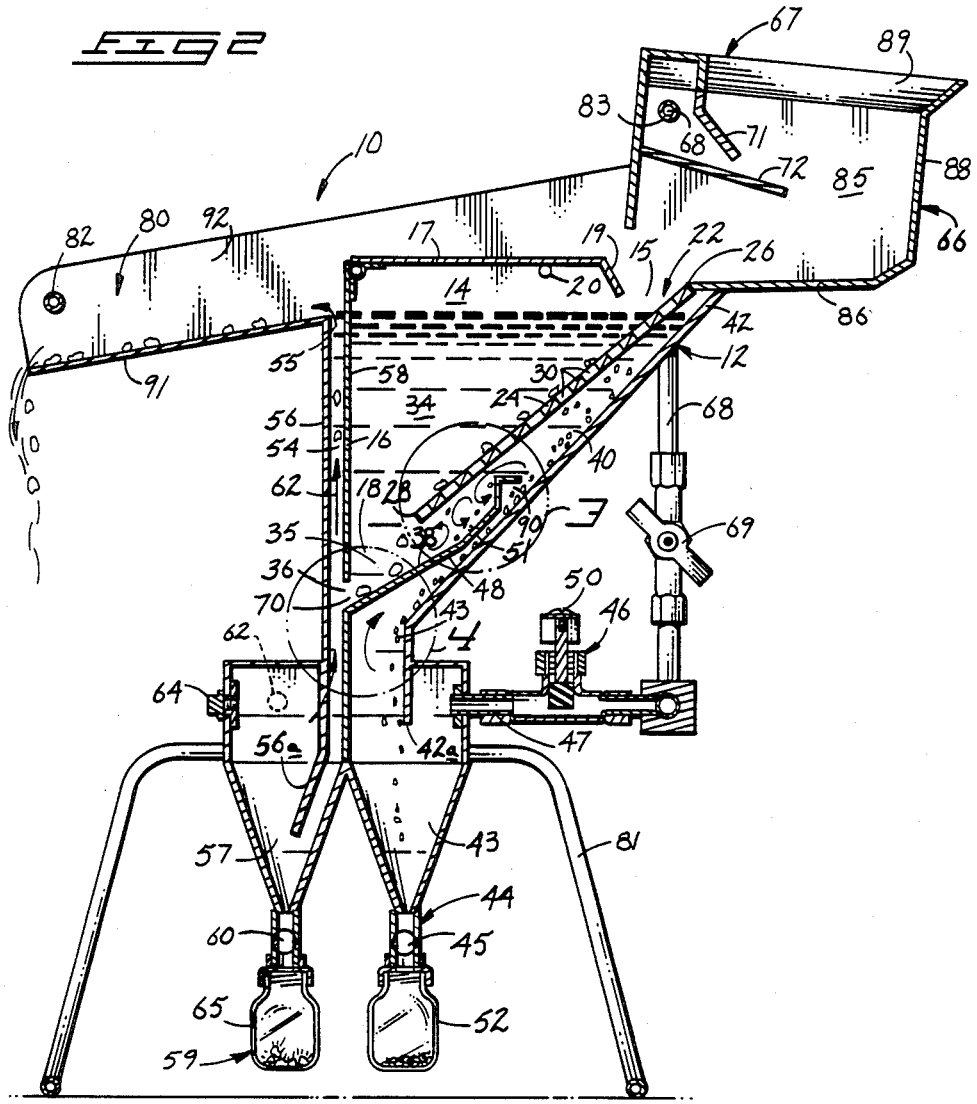
FIG. 2 is a side cross-sectional view of the heavy metal separator shown in FIG. 1.

The heavy metal separator 10 shown in FIG. 1 and FIG. 2 has a separation chamber 12 adapted to receive the slurry. The separation chamber 12 has an upper end 15 and a lower end 18. The upper end 15 of separation chamber 12 is open and provides a passage for the slurry into separation chamber 12. The initial separation of the ore into fine and coarse concentrate material takes place in separation chamber 12. Fine particles of heavy metal are also separated from the fine waste material in separation chamber 12.

The separation chamber 12 of heavy metal separator 10 has a side wall 13 and a side wall 14. Side wall 13 and side wall 14 are joined by a front wall 16 and a rear inclined wall 42. Separation chamber 12 also has a top cover 17 which has a hinged connection with front wall 16 for rotational movement from a closed position as shown in FIG. 2 to an open position as shown in FIG. 1. All the walls and the top cover 17 of separation chamber 12 in the preferred embodiment are formed of a light gauge corrosion resistant metal.

The top cover 17 can be opened so that the operator has access to separation chamber 12 for cleaning and removal of material which may be stuck in separation chamber 12. The top cover 17 is provided with a baffled end 19. The baffled end 19 assists in directing the ore in a downward direction into separation chamber 12 when top cover 17 is in its closed position. A stop 20 formed on side wall 14 of separation chamber 12 prevents top cover 17 from rotating downwardly beyond the position shown in FIG. 2.

Mounted within separation chamber 12 is a screen means 22 which in the preferred embodiment includes a screen 24. Screen 24 has a feed end 26 adjacent the upper end 15 of separation chamber 12. The screen 24 is inclined downwardly from feed end 26 as shown in FIG. 1 and terminates at discharge end 28. The screen 24 divides the separation chamber 12 into a first section 34 which is above screen 24 and outward from discharge end 28, and a second section 40 disposed below the screen 24.

The screen 24 extends from side wall 13 to side wall 14, to prevent any ore from spreading outwardly over the sides of screen 24 and down into the second section 40.

In the preferred embodiment, the screen 24 has a plurality of offset rows of perforations 30 which have $\frac{1}{8}$ inch (0.3175 cm) diameter. The $\frac{1}{8}$ inch (0.3175 cm) diameter perforations 30 allow heavy metal particles and waste particles of up to $\frac{1}{8}$ inch (0.3175 cm) diameter to pass downwardly through the screen 24 into the second section 40. All ore material over $\frac{1}{8}$ inch (0.3175 cm) diameter in size will continue moving downwardly along screen 24 and drop off discharge end 28 as coarse concentrate into first section 34.

The ore flows downward into separation chamber 12, where it is received by screen 24. The screen 24 initially separates the ore into fine and coarse concentrates, allowing fine particles of heavy metal and fine waste particles to pass through and settle downwardly into the second section 40. The ore moves gravitationally downward across the screen 24 as the separation process takes place. The concentrate including coarse waste and heavy metal particles eventually move off the discharge end 28 of screen 24 into the first section 34.

In order to provide efficient initial separation of the ore into fine and coarse material, it has been experimentally determined that the screen should be mounted at an inclined angle of approximately 40° with respect to horizontal. It has also been experimentally determined that approximately 3 to 4 inches (7.62 to 10.16 cm) of screen 24 length as measured from its feed end 26 is sufficient. With this configuration there is sufficient time and surface area for all of the fine concentrates to pass through screen 24 into second section 40 as the ore concentrates pass downwardly over the screen 24.

The first section 34 lies above screen 24 and outwardly from discharge end 28 of screen 24. The first section 34 has a lower end 35. The first section 34 also has an outlet 36 below the discharge end 28 passing through front wall 16 of separation chamber 12. The outlet 36 provides an opening through which the coarse concentrate moving downwardly into first section 34 can pass, along with water and fine waste particles which have been washed into first section 34 from second section 40.

The first section 34 also has a lower inclined wall 38 which is adapted to receive the fine waste particles from the second section 40 and the coarse concentrates moving downwardly into first section 34 from screen 24. Inclined wall 38 guides the coarse concentrates and fine waste material downwardly through first section 34 to outlet 36.

The second section 40 is situated below screen 24 and receives the fine concentrates which pass through screen 24. The inclined wall 42 forms one of the principal boundaries of the second section 40. The inclined wall 42 is disposed beneath screen 24, and is adapted to receive the fine particles and flakes of heavy metal and the fine waste material, and guide them gravitationally downward. In the preferred embodiment inclined wall 42 is also one wall of separation chamber 12. The inclined wall 42 provides a surface which orients the fine heavy metal flakes with their major elongated dimension parallel to inclined wall 42.

Through experimentation it has been determined that wall 42 should be at an angle of approximately 47° with respect to horizontal for maximum efficiency of the heavy metal separator 10.

Figure 3:
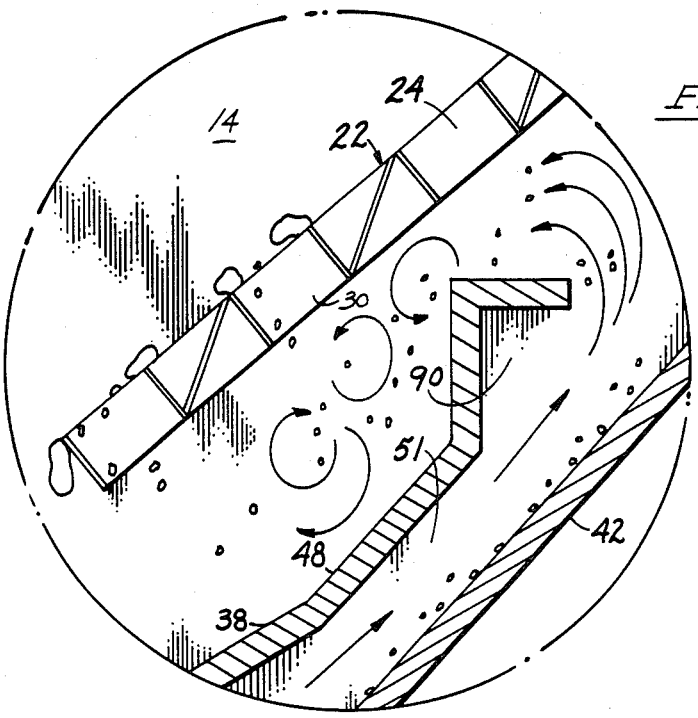
FIG. 3 is an enlarged cross-sectional view of the area circled and referenced with the numeral 3 in FIG. 2.
Figure 4:
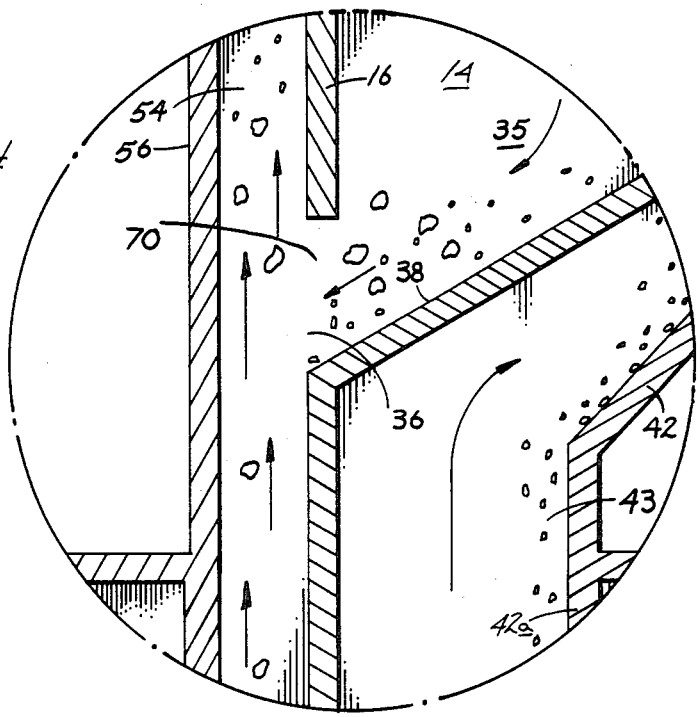
FIG. 4 is an enlarged cross-sectional view of the circled area labeled with the reference numeral 4 of FIG. 2.

As shown in FIG. 2, FIG. 3 and FIG. 4, there is a baffle 48 mounted in second section 40 of separation chamber 12. The baffle 48 directs an upwardly ascending stream of water through second section 40 in a direction opposite to the direction of the downwardly moving flow of fine concentrates along the inclined wall 42.

The baffle 48 extends from side wall 13 to side wall 14 and has a flow section 51 and a settling section 90. The flow section 51 is parallel to inclined wall 42. In the preferred embodiment, the flow section 51 is spaced approximately 0.16 inches (0.4064 cm) from inclined wall 42. The baffle 48 has a necked down area which gradually increases the velocity of water until it reaches flow section 51 at which point the velocity of the water is at its highest and the direction of flow is in a direction parallel to and opposite the downwardly moving fine concentrates, as is illustrated in enlarged detail in FIG. 3.

The settling section 90 is spaced outwardly from inclined wall 42 a distance greater than the spacing between flow section 51 and inclined wall 42. The widened area between settling section 90 and inclined wall 42 provides an area of abruptly decreased water velocity with respect to the upwardly moving stream of water which is passing between flow section 90 and inclined wall 42. This area of decreased water velocity allows the fine heavy metal particles and flakes to settle out of the stream of water down onto inclined wall 42 and downwardly into the lower end 43 of second section 40. As the water moves upwardly through the second section 40 in a direction opposite to the downward movement of the fine concentrates, as shown in FIG. 2 and FIG. 3, the upwardly ascending flow of water washes fine waste particles upward and out of the second section 40 into the first section 34 as shown in FIG. 3.

The opening between inclined wall 42 and settling section 90 is elevationally higher than outlet 36. This allows the fine waste material which is washed from second section 40 to settle gravitationally downward to outlet 36 for eventual removal from heavy metal separator 10.

The lower end 43 of the second section 40 has a much higher volume than the upper area of second section 40. The wall 42 may extend downwardly into the lower end 43 to form a baffle 42*a*. The baffle 42*a* extends downwardly past the inlet 47 to deflect water coming in through inlet 47 and minimize turbulence in lower end 43. Because of the high volume of the lower end 43, the water velocity in an upward direction is much lower there than in the flow section 51. This area of lower water velocity allows the fine heavy metal particles to easily pass through lower end 43.

In the preferred embodiment, the second section 40 also has a collection means 44 at its lower end 43 for collecting fine heavy metal particles and flakes which have passed downwardly through second section 40. The collection means 44 consists of a collection bottle 52 and a collection valve 45.

Second section 40 of separation chamber 12 has a water inlet means 46 shown in FIG. 1 and FIG. 2. The water inlet means includes second water inlet 47 and an adjustment valve 50 for adjusting the volume of water entering second section 40.

Located at the upper end of the heavy metal separator 10 is a feed means 66 for receiving and feeding the ore into the separator 10. In the preferred embodiment as illustrated in FIG. 1 and FIG. 2, the feed means consists of a feed hopper 67. The feed hopper 67 is generally rectangular in shape, having a bottom wall 86 supporting side wall 84 and side wall 85. A front wall 87 and rear wall 88 extend upwardly from bottom wall 86 between side wall 84 and side wall 85. The top edges are all turned outwardly to form flanges 89 around the upper periphery of feed hopper 67.

Feed hopper 67 communicates with the separator 10 through an opening between the bottom wall 86 and front wall 87 of feed hopper 67. The ore moves from the feed hopper 67 into the separator 10 through the opening between bottom wall 86 and front wall 87 of feed hopper 67.

A feed water inlet 68 is provided adjacent the upper section of front wall 87. It consists of a tube 83 extending across feed hopper 67 from side wall 84 to side wall 85, with the tube 83 having a plurality of holes spaced across its length. The holes provide an even flow of water from the tube 83 across the width of feed hopper 67. To assist in generating an even flow of water from the tube, feed hopper 67 has a water inlet baffle 71 spaced away from front wall 87 and extending between side wall 84 and side wall 85. The water/ore (slurry) flow along a feed plate 72 which extends downwardly from front wall 87. A feed water inlet valve 69 is in water inlet tube 83 to control the flow of water through feed water inlet 68.

Bottom wall 86 is inclined downwardly from rear wall 88 to the upper end of the separator 10. This allows the slurry to gravitationally move into separation chamber 12.

The preferred embodiment of the heavy metal separator 10 as shown in FIG. 2 and FIG. 3 also has a second chamber 54 which is located adjacent to separation chamber 12. The second chamber 54 has an upper discharge end 55 and a lower end 57. Second chamber 54 is in communication with the first section 34 of separation chamber 12 through opening 36. The second chamber 54 is adapted to receive water, coarse concentrate, and fine waste particles from first section 34 through opening 36.

The second chamber 54 has an outer wall 56 and an inner wall 58 extending preferably between side wall 13 and side wall 14. In the preferred embodiment, inner wall 58 and outer wall 56 are parallel and spaced 0.25 inch (0.635 cm) from one another. In the preferred embodiment as shown in FIG. 2, the inner wall 58 of second chamber 54 is also the front wall 16 of separation chamber 12.

Attached to lower end 57 of second chamber 54 is a second water inlet 62, which provides an upwardly moving stream of water through second chamber 54. Attached to second water inlet 62 is a second inlet valve 63 (FIG. 1), which is used to adjust the volume of water flowing into second chamber 54 through second water inlet 62. The wall 56 extends into the lower end 57 of chamber 54 to function as a baffle **56*a* against the water fed through opening 62. The baffle 56*a* serves to reduce turbulence in the water ascending through chamber 54 and evens the upward flow velocity over its entire cross section between walls 56, 58, and side walls 13, 14**.

Also attached at the lower end 57 of second chamber 54 is a collection means 59 for collecting the larger gold particles which have been separated from the ore concentrates passing into second chamber 54. The collection means 59 includes a second collection valve 60 and a second collection bottle 65.

The ascending stream of water in second chamber 54 moves upwardly into the stream of coarse concentrates and fine waste material which pass into second chamber 54 from first section 34, washing the waste material out upper discharge end 55, allowing coarse heavy metal particles and flakes to pass downwardly through the ascending stream of water into the lower end 57 of the second chamber 54.

The lower end 57 of second chamber 54 has a much larger volume than the narrow channel between outer wall 56 and inner wall 58. Because of this, the water velocity in lower end 57 is much lower than the water velocity in the channel between walls 56 and 58, which allows the heavy metal particles to settle downwardly through lower end 57.

Second chamber 54 has a cleaning port 64 in lower end 57 for cleaning second chamber 54. At lower end 57 is also a second collection valve 60, which can be rotated to close the narrowed portion of lower end 57 to prevent material from passing through lower end 57 into second collection bottle 65.

As shown in FIG. 1 and FIG. 2, there is a discharge trough 80 adjacent to upper end 55 of second chamber 54. The discharge trough 80 has a base 91 and two side walls 92 and 93 that may be coincidental with walls 13, 14. A handle 82 (FIG. 1) is provided at the discharge end of discharge trough. The handle 82 provides a convenient means for grasping heavy metal separator 10, as well as providing structural rigidity between side 92 and side wall 93. The base 91 of discharge trough 80 is sloped slightly downward from the upper end 55 of second chamber 54 so that water and waste material will gravitationally flow downward and away from upper end 55 of second chamber 54.

In the preferred embodiment, water inlet 47, second water inlet 62, and feed water inlet 68 all have a common connection at main water inlet 95 (FIG. 1). With the common connection to the single inlet 95, it is only necessary to have one source of water rather than two or three.

As shown in FIG. 1, heavy metal separator 10 also has legs 81. The legs 81 are detachably affixed to the frame and provide a convenient means for placing and maintaining heavy metal separator 10 in its operable position.

The preferred embodiment of heavy metal separator 10 will usually be utilized to separate heavy metal particles and flakes from ore which has already gone through a sizing operation. This preliminary sizing operation will normally be done using something such as a screen to separate out any larger materials from the ore concentrates. The heavy metal separator 10 as described earlier is able to separate ore which includes individual particles which measure no more than ¼ inch (0.635 cm) in diameter.

To operate, the heavy metal separator is placed upon the ground or on a support in the position shown in FIG. 2. A water hose or pipe of some kind is attached to the main water inlet 95. With the arrangement of water valves and water inlets into the various components of the heavy metal separator as shown in FIG. 1, the device only requires one water supply hose in order to be operable.

In normal use, the main water inlet 95 can be attached to a hose running from any usual water supply, such as a household water supply, if the heavy metal separator 10 is being used near such a source of supply. If the heavy metal separator 10 is being used in a remote area, all that is required is a small pump to provide the required water pressure. Through experimentation, it has been discovered that a pump for the embodiment shown and described herein should have a discharge pressure of about eighteen pounds per square inch (12.6558 grams per square millimeter) minimum. The heavy metal separator 10 will operate at that pressure utilizing approximately ten gallons (37.85 liters) of water per minute. In the event that water is in short supply, the water and waste material combination can be collected as it flows off the discharge end of discharge trough 80, and the water can be recovered and recycled through the separator.

Once the water supply (not shown) is connected to the main water inlet 95, the adjustment valve 50 and the second inlet valve 63 are adjusted to provide an initial water flow into the first section 34 and second chamber 54. Feed water valve 69 is adjusted to provide an initial flow of water into feed hopper 67. In actual use, once the heavy metal separator 10 has been operated, all three of the above-mentioned water adjustment valves would normally be left in the same position that they were in during the prior usage, since all necessary adjustments would have already been made. If any new adjustments to the three water inlet valves are necessary, they are only minor adjustments.

Initial adjustments of valves 50 and 63 may be made by first fully opening both valves to let the chambers 12, 54 fill to the point where overflow begins over the upper end 55 of chamber 54. The operator then adds ore to the hopper 67. While watching the collection bottle 52, the user slowly closes the valve 46 until waste material begins to appear in bottle 52. At this time the closing motion is stopped. For "fine tuning," the valve 46 may be reopened one quarter turn from the first appearance of waste particles in the bottle 52. The user may concentrate on adjusting the second water inlet valve 63 in the same manner by slowly closing valve 63 until large waste particles appear in bottle 65. Valve 63 may also be "fine tuned" by opening it one quarter turn after waste particles appear in bottle 65. Following these adjustments, the separation is ready for use.

Once the necessary water inlet adjustments have been made, more ore is introduced into feed hopper 67. Water flowing into the feed water inlet 68 and through tube 83 washes downwardly across feed plate 72 and into feed hopper 67. The ore is positioned on feed plate 72 and on bottom wall 86 of feed hopper 67. As the water runs downwardly through the feed hopper, it mixes with the ore forming a slurry. The ore and water slurry gravitationally moves downwardly along wall 86 and onto feed end 26 of screen 24. As the material is washed outwardly from feed hopper 67 onto screen 24, the cleaning door flange 19 prevents any ore concentrate from being washed over cleaning door 17 and into discharge trough 80. The flange 19 thus prevents any loss of ore concentrate through discharge trough 80.

The ore washed over the feed end 26 moves gravitationally downward across screen 24. As the ore moves across screen 24, any material, including heavy metal particles and flakes and waste particles having a diameter of ⅛ inch (0.3175 cm) or less settle downwardly through the perforations 30 of screen 24 and settle into second section 40. Since most of screen 24 will be under water level when the separator is being operated, and since the ore is fed across screen 24 in the form of a slurry, there is good separation of material ⅛ inch (0.3175 cm) or less in diameter from the rest of the concentrates as they pass across screen 24. The coarse ore concentrates which remain on the screen move downwardly to the discharge end 28 of screen 24 and settle into first section 34.

As the fine ore concentrate settles down into second section 40, it settles onto inclined wall 42 and moves gravitationally downward through first section 34 along inclined wall 42. As the fine concentrates move along inclined wall 42, any fine flakes of heavy metal will settle into a position on inclined wall 42 with their largest dimension parallel with inclined wall 42. This position of the heavy metal flake will present the smallest cross sectional area or profile with respect to the upwardly moving stream of water which is ascending through second section 40 from water inlet 47.

The fine concentrates move gravitationally downward across inclined wall 42, and into the upwardly moving stream of water passing between inclined wall 42 and baffle 48. The action of the water is illustrated in the FIG. 3 enlarged cross sectional view of the opening between baffle 48 and inclined wall 42. The upwardly moving stream of water passing between baffle 48 and inclined wall 42 washes the less dense waste particles in an upward direction through second section 40. At the same time, the much denser heavy metal particles and heavy metal flakes continue to move downwardly along inclined wall 42.

Since some of the smaller heavy metal particles and flakes may weigh near what some of the larger fine waste particles weigh, there is an enlarged settling area 90 provided at the upper end of baffle 48. The enlarged area 90, which is also illustrated in FIG. 3, provides an area of lower water velocity compared with the flow area between baffle 48 and inclined wall 42. This area of lower water velocity allows the smaller lighter particles of heavy metal to settle downwardly through the ascending stream of water. Without an area of lower velocity, some small heavy metal particles would wash over the upper end of baffle 48 and into first section 34. As the heavy metal particles and flake pass downwardly through the opening between baffle 48 and inclined wall 42, they continue moving gravitationally downward through the lower end 43 of second section 40 until they reach collection valve 45 and pass through collection valve 45 into collection bottle 52. The collection valve 45 is closed when collection bottle 52 is removed from lower end 43 of second section 40. The collection valve 45 prevents any loss of heavy metal particles or flakes when the collection bottle 52 is removed.

Any adjustments required in the flow of water upward through second section 40 are made based upon the type of material which is seen moving into collection bottle 52. The normal adjustment which is made during operation will be to decrease the volume of water entering second section 40 by slowly closing water inlet valve 47 until some fine waste particles begin to appear in collection bottle 52. The valve is then adjusted to slowly increase the volume of water flowing into second section 40 until no more waste material particles are seen entering collection means 52.

The fine waste particles which have entered second section 40 through screen 24 are washed upwardly and out of first section 40 over the upper end of baffle 48 as shown in FIG. 3. The fine waste particles then move gravitationally downward across lower wall 38 of first section 34. In the preferred embodiment as shown in FIG. 2, lower wall 38 and baffle 48 are integral. Using baffle 48 as lower wall 38 of first section 34 decreases cost, since an additional metal piece is not required and there is a time saving in manufacturing the heavy metal separator 10.

As the separation operation is continued, the water from separation chamber 12 as well as fine waste particles and coarse concentrate material which has moved downwardly along screen 24 and off its discharge end 28 reach outlet 36 in the lower end 35 of first section 34.

At the same time the stream of water is moving upwardly through first section 40, there is also a stream of water moving upwardly through second chamber 54. The water which passes through second chamber 54 moves out of the lower end 57 of second chamber 54 upwardly between inner wall 58 and outer wall 56 until it passes out of upper discharge end 55 and onto discharge trough 80.

As the separation operation continues, and the material moving downwardly along lower wall 38 reaches outlet 36, it is gravitationally moved into inlet opening 70 of second chamber 54. The material moving into second chamber 54 passes into the upwardly moving stream of water in second chamber 54. The fine waste materials moving into second chamber 54 are washed upwardly by the ascending water and out of upper end 55. They then flow through discharge trough 80 with the water. The coarse concentrates move downwardly off of discharge end 28 of screen 24 and reach the upwardly moving stream of water through second chamber 54. The large heavy metal particles and heavy metal flakes have sufficient density to pass downwardly through the ascending stream of water through chamber 54 until they reach the lower end 57 of second chamber 54. The heavy metal particles and flakes will be collected in second collection bottle 65. The action of the water is illustrated in FIG. 4. Second chamber 54 also has a collection valve 60 which can be closed, so that the collection bottle 65 can be removed and emptied when it is filled with heavy metal particles and flakes.

The volume of water flowing into both separation chamber 12 and second chamber 54 through second water inlets 47 and 62 respectively can also be adjusted during operation. The adjustment of both valves may be made in essentially the same way as described above. It is preferred that the adjustments be made consecutively rather than simultaneously. Thus one of the valves 46, 63 will be slowly closed until particles of waste material begin to appear in the associated collection bottle 52 or 65. Once the waste particles are visible in the associated collection bottle, the water inlet valve 46 or 63 is slowly opened until no more waste particles appear. The valve may then be opened another quarter turn to "fine tune" the water flow. Once the adjustments have been made to water inlet means 46 and second water inlet 62, there will normally be no further adjustments required unless there is another variation in the water pressure in the water line which is attached to the main water inlet 95. Should the pressure vary, the above adjustment procedures can be repeated.

As the separation operation utilizing the heavy metal separator 10 continues, ore concentrates are continually fed into feed hopper 67 until the ore concentrates have all been processed. At the end of processing, the only thing required is to disconnect the water supply from the main water inlet 95 and clean the heavy metal separator of any material which may remain within it. The cleaning can be accomplished through cleaning port 64 of second chamber 54 and through cleaning door 17. The heavy metal separator 10 is then ready for further use, with all the initial settings on the water inlet valves having already been made so that it is only necessary to make fine adjustments to the water inlet valves the next time the separator is used.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

I claim:

1. A heavy metal separator for separating ore consisting of fine and coarse material into heavy metal particles and waste particles in which the heavy metal particles include fine heavy metal flakes having an elongated major dimension, comprising:

means defining a separation chamber having an upper and a lower end;

screen means mounted in the chamber, having a feed end adjacent the upper end of the chamber, extending downwardly at an inclined angle to a discharge end, the screen means dividing the chamber into a first section above the screen means and a second section below the screen means with the screen means positioned to receive the ore and adapted to allow the ore to gravitationally move downward over the screen means with the fine material passing therethrough and descending into the second section;

an inclined wall, forming part of the second section and situated below the screen means, positioned to receive the fine material and to direct it on a downward path;

a first water inlet means connected to the second section for providing an ascending stream of water into the second section; and baffle means mounted in the separation chamber having one end located in said second section for directing the stream of water in a direction opposite the fine material moving on said downward path for washing waste particles from the fine material and directing the waste particles from the second section into the first section;

the inclined wall in conjunction with the baffle means defines a flow passage which is adapted to orient the fine heavy metal flakes with their elongated major dimension substantially parallel with the inclined wall to minimize the cross sectional area of the flakes perpendicular with the inclined wall.

2. The heavy metal separator of claim 1;

wherein the baffle means includes a lower flow section spaced away from the inclined wall and an upper settling section spaced farther from the inclined wall than the flow section, the settling section providing an area of lower water velocity to allow the heavy metal particles and flakes to settle downward through the ascending stream of water.

3. The heavy metal separator of claim 1, wherein the second section has a lower end, further comprising:

first collection means at the lower end of the second section for collecting the fine heavy metal particles and flakes passing downwardly through the second section.

4. The heavy metal separator of claim 1, further comprising:

adjustment means on the first water inlet means for adjusting the volume of water entering the second section.

5. The heavy metal separator of claim 1, further comprising:

means defining a second chamber having an upper discharge end and a lower end, the second chamber being in communication with the first section, adapted to receive the stream of water and coarse material and fine waste particles from the first section for separation of the heavy metal particles from the coarse material and fine waste particles.

6. The heavy metal separator of claim 1, further comprising:

means defining a second chamber having an upper discharge end and a lower end, the second chamber being in communication with the first section, adapted to receive the stream of water and coarse material and fine waste particles from the first section for separation of the heavy metal particles from the coarse material and fine waste material; and second water inlet means at the bottom of the second chamber for providing an upwardly ascending stream of water through the second chamber into the stream of coarse material and fine waste material for washing waste material out of the upper discharge end of the second chamber and allowing heavy metal particles to settle through the upwardly ascending stream of water into the lower end of the second chamber.

7. The heavy metal separator of claim 1, further comprising:

means defining a second chamber having an upper discharge end and a lower end, the second chamber being in communication with the first section, adapted to receive the stream of water and coarse material and fine waste particles from the first section for separation of the heavy metal particles from the coarse material and fine waste material;

second water inlet means at the bottom of the second chamber for providing an upwardly ascending stream of water through the second chamber into the stream of coarse material and fine waste material for washing coarse and fine waste material out of the upper discharge end of the second chamber and allowing the heavy metal particles to settle into the lower end of the second chamber; and second collection means at the bottom of the second chamber for collecting the heavy metal particles.

8. The heavy metal separator of claim 1, further comprising:

a feed means at the upper end of the chamber for feeding the ore onto the feed end of the screen means;

a third water inlet means in the feed means for introducing water into the ore to form a slurry mixture in the feed means.

9. The heavy metal separator of claim 1, wherein the first section has a lower end with an outlet therethrough for passage of the water and coarse material and the fine waste particles from the first section.

10. The heavy metal separator of claim 9, wherein:

said baffle means is positioned to guide the coarse material and fine waste particles gravitationally downward through the first section to the outlet.

11. The heavy metal separator of claim 1, wherein the second section includes a lower end and wherein the first water inlet means is situated within the lower end; and first chamber baffle means within the lower end adjacent the first water inlet means for deflecting water entering through the first water inlet means and for minimizing turbulence in the lower end.

12. The heavy metal separator of claim 1 further comprising means defining a second chamber in communication with the first section for receiving water, coarse material and fine waste particles from the first section;

second water inlet means in the second chamber for directing an upwardly ascending stream of water through the second chamber and against the coarse material and fine waste particles received from the first section to separate the fine and coarse waste material from the coarse heavy metal particles; and second chamber baffle means in the second chamber adjacent the second water inlet means for deflecting water entering through the second water inlet means and for minimizing turbulence and evening flow across the ascending stream of water within the second chamber.

13. A heavy metal separator for separating ore consisting of fine and coarse material into heavy metal particles and waste particles in which the heavy metal particles include fine heavy metal flakes having an elongated major dimension, comprising:

means defining a separation chamber having an upper end and a lower end;

an inclined screen mounted in the chamber having a feed end adjacent the upper end of the chamber, extending downwardly at an inclined angle to a discharge end, the screen dividing the separation chamber into a first section above the screen and a second section below the screen, the screen being positioned to receive the ore and adapted to allow the ore to gravitationally move downward over the screen with the fine material passing through the screen and descending into the second section and with the coarse material passing off the discharge end into the first section;

an inclined wall, forming part of the second section and situated below the screen means, adapted to receive the fine material and to direct it on a downward path;

feed means at the upper end of the chamber for feeding the ore onto the feed end of the screen;

first water inlet means on the second section for providing an ascending stream of water into the second section;

baffle means in the separation chamber and having one end located in said second section for directing the stream of water parallel to and along the inclined wall in a direction opposite the fine materials moving on said downward path for separating the fine heavy metal particles including the flakes from the fine waste particles and for moving the fine waste particles from the second section to the first section;

the inclined wall in conjunction with the baffle means defines a flow passage which is adapted to orient the fine heavy metal flakes with their elongated major dimension substantially parallel with the inclined wall to minimize the cross sectional area of the fine flakes perpendicular with the inclined wall;

means defining a second chamber, having an upper discharge end and a lower collection end, the second chamber in communication with the first section for receiving the coarse materials and fine waste particles from the first section; and a second water inlet means in the second chamber for providing an upwardly ascending stream of water into the second chamber into the stream of coarse materials and fine waste material for separating the coarse heavy metal particles from the coarse and fine waste particles and carrying the coarse and fine waste material upward and out the upper discharge end of the second chamber.

14. The heavy metal separator of claim 13, wherein said baffle means includes a lower section parallel to and spaced away from the inclined wall for providing an area of constant water velocity, and an upper section spaced further from the inclined wall than the first section for providing an area of lower water velocity so the fine heavy metal particles and flakes will settle through the ascending stream of water.

15. The heavy metal separator of claim 13, further comprising:

a valve on the second water inlet means for adjusting the flow of water into the second chamber.

16. The heavy metal separator of claim 13, further comprising:

a third water inlet means in the feed means for forming a slurry with the ore.

17. The heavy metal separator of claim 13, wherein the first section has a lower end with an outlet therethrough for passage of the water and coarse materials and the fine waste material from the first section.

18. A heavy metal separator for separating ore consisting of fine and coarse material into heavy metal particles, heavy metal flakes, and waste particles in which the heavy metal particles include fine heavy metal flakes having an elongated major dimension, comprising:

means defining a first separation chamber having an upper and a lower end;

an inclined screen mounted in the separation chamber having a feed end adjacent the upper end of the chamber extending downwardly at an inclined angle to a discharge end, the screen dividing the separation chamber into a first section above the screen, and a second section below the screen, the first section having a lower end with an outlet therethrough, with the screen being positioned to receive the ore and adapted to allow the ore to gravitationally move downward over the screen with the fine material passing through the screen and descending into the second section and the coarse material moving off the discharge end into the first section;

an inclined wall forming one side of the second section, the wall being disposed under the screen, adapted to receive the fine material and guide it downward path through the second section;

a first water inlet means in the second section for providing an ascending stream of water through the second section;

baffle means mounted in the separation chamber and having one end located in said second section and having a flow section parallel to and spaced away from the inclined wall for directing the ascending stream of water parallel to and along the wall in a direction opposite the fine material moving on said downward path and a settling section spaced further from the inclined wall than the flow section to provide an area of lower water velocity to allow fine particles and flakes of heavy metal to settle downwardly through the stream of water;

means defining a second chamber having a lower end and an upper discharge end, with an opening intermediate its ends communicating with the outlet in the first section for receiving the stream of coarse material and fine waste particles from the first section;

a second water inlet means in the second chamber for providing an upwardly ascending stream of water past the opening into the stream of concentrate and fine waste particles and out the discharge end, the stream of water washing waste particles out of the upper discharge end while allowing heavy metal particles and flakes to move downwardly into the lower end of the second chamber; and feed means at the upper end of the first separation chamber for feeding the ore onto the feed end of the screen.

19. The heavy metal separator of claim 18 wherein the baffle means has an inclined lower section for receiving and guiding the coarse materials and fine waste particles gravitationally downward through the first section to the outlet.

20. The heavy metal separator of claim 18, further comprising:

a third water inlet means in the feed means for introduction of water into the ore to form a slurry.

21. The heavy metal separator of claim 18, further comprising:

first collection means on the second section for collecting fine heavy metal flakes which pass downwardly through the second section.

22. The heavy metal separator of claim 18, further comprising:

second collection means at the lower end of the second chamber for collecting coarse heavy metal particles and flakes which pass downward through the second chamber.

* * * * *